US010204754B1

(12) United States Patent
Chen et al.

(10) Patent No.: US 10,204,754 B1
(45) Date of Patent: Feb. 12, 2019

(54) KEYBOARD DEVICE

(71) Applicant: ACER INCORPORATED, New Taipei (TW)

(72) Inventors: Hung-Chi Chen, New Taipei (TW); Yi-Hsuan Yang, New Taipei (TW); Po-Yi Lee, New Taipei (TW); Chi-Hung Lai, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/796,876

(22) Filed: Oct. 30, 2017

(30) Foreign Application Priority Data

Sep. 14, 2017 (TW) ..... 106131595 A

(51) Int. Cl.
*H01H 13/85* (2006.01)

(52) U.S. Cl.
CPC ..... *H01H 13/85* (2013.01); *H01H 2215/004* (2013.01); *H01H 2221/036* (2013.01)

(58) Field of Classification Search
CPC ..... H01H 13/85; H01H 2215/004; H01H 2221/036
USPC ..... 200/513, 516, 406, 512
See application file for complete search history.

(56) References Cited

U.S. PATENT DOCUMENTS

2006/0201797 A1* 9/2006 Rastemborski ..... H01H 13/48 200/516
2012/0073943 A1* 3/2012 Tseng ..... H01H 13/703 200/5 A

FOREIGN PATENT DOCUMENTS

| | | | |
|---|---|---|---|
| CN | 104919558 | A | 9/2015 |
| CN | 204681674 | U | 9/2015 |
| CN | 105206456 | A | 12/2015 |
| TW | 510562 | | 11/2002 |
| TW | 201725598 | A | 7/2017 |
| TW | M548879 | U | 9/2017 |

* cited by examiner

*Primary Examiner* — Edwin A. Leon
*Assistant Examiner* — Lheiren Mae A Caroc
(74) *Attorney, Agent, or Firm* — Winston Hsu

(57) ABSTRACT

A keyboard device includes a substrate, a thin film switch circuit, and a trigger device having a rubber dome and a metal dome. The trigger device is configured to trigger the thin film switch circuit in response to an external force. The rubber dome is arranged to provide a first tactile feel during a first pressing process while the external force is exerted and provide a first rebound force during a first relieving process after the external force has been removed. The metal dome is arranged to provide a second tactile feel during a second pressing process while the external force is exerted and provide a second rebound force during a second relieving process after the external force has been removed.

10 Claims, 13 Drawing Sheets

KEYBOARD DEVICE

CROSS REFERENCE TO RELATED APPLICATION

This application claims priority of Taiwan Patent Application No. 106131595 filed on 2017 Sep. 14.

BACKGROUND OF THE INVENTION

1. Field of the Invention

The present invention is related to a keyboard device, and more particularly, to a keyboard device capable of providing high rebound force and two stages of tactile feel.

2. Description of the Prior Art

With rapid development of technology, various electronic devices, such as desktop computers, laptop computers and mobile phones, have become essential in daily life. Generally, an input device is required to operate an electronic device, such as using a mouse or a keyboard to move cursor or input data to a computer. With the trend of miniaturized electronic products, traditional mechanical keyboard with longer strokes become inapplicable. Therefore, small-sized portable devices normally adopt thin film keyboards.

FIG. 1 is a diagram illustrating a bounce curve of a prior art thin film keyboard. The horizontal axis represents the distance of keycap stroke (in millimeters). The vertical axis represents the pressure (in grams) observed by user finger when the keycap is being pushed downwards or rebounding. Curve 1 represents the pressing process when the keycap is being pushed downwards, and Curve 2 represents the relieving process when the keycap is rebounding. Point O is the start point, Point P is the peak point, Point R is the rebound point, Point M is the maximum rebound point, and Point E is the finish point.

Before pressing the keycap, the observed finger pressure is of the value represented by Point O on the bottom-left of the bounce curve. When the keycap is being pushed downwards, the finger encounters more pressure and the distance of the stroke increases as Curve 1 moves towards the top-right of the bounce curve. When the side wall of the rubber dome is no longer able to hold the pressure, it is close to undergo deformation, and the observed finger pressure is of the value represented by the peak point P. When the side wall of the rubber dome starts to undergo deformation after the peak point P, the observed finger pressure is decreasing as Curve 1 moves towards the bottom-right of the bounce curve. At the contact point C, the keycap comes in contact with the circuit board or thin film conducting layer, thereby forming a conducting signal transmission path. Since the keycap has reached the bottom of the structure after the contact point C, any further stroke distance may encounter large amount of resilience from the deformed rubber material. Therefore, the observed finger pressure at the finish point E may be very large.

Since Curve 2 represents the relieving process when the keycap is rebounding, it starts from the right side of the bounce curve. When the keycap is released, all pressure accumulated during the deformation of the rubber dome is instantly released (the rebounding force observed by the finger) and Curve 2 moves from point E to the rebound point R. When the deformed rubber dome resumes the shape when just coming in contact with the circuit board or thin film conducting layer, it starts to rebound until regaining its original shape, during which the rebounding pressure increases. After the rubber dome regains its original shape at the maximum rebounding point M, the rebounding pressure decreases until reaching the start point O.

Limited to the characteristics of rubber material, the prior art thin film keyboard is unable to provide high rebounding tactile feel similar to that provided by mechanical keyboards.

SUMMARY OF THE INVENTION

The present invention provides a keyboard device including a substrate, a thin film switch circuit disposed on the substrate, and a trigger device configured to trigger the thin film switch circuit in response to an external force and including a rubber dome and a metal dome. The rubber dome includes a protrusive part and is arranged to provide a first tactile feel during a first pressing process while the external force is exerted and provide a first rebound force during a first relieving process after the external force has been removed. The metal dome is integrated with the rubber dorm and arranged to provide a second tactile feel during a second pressing process while the external force is exerted and provide a second rebound force during a second relieving process after the external force has been removed.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
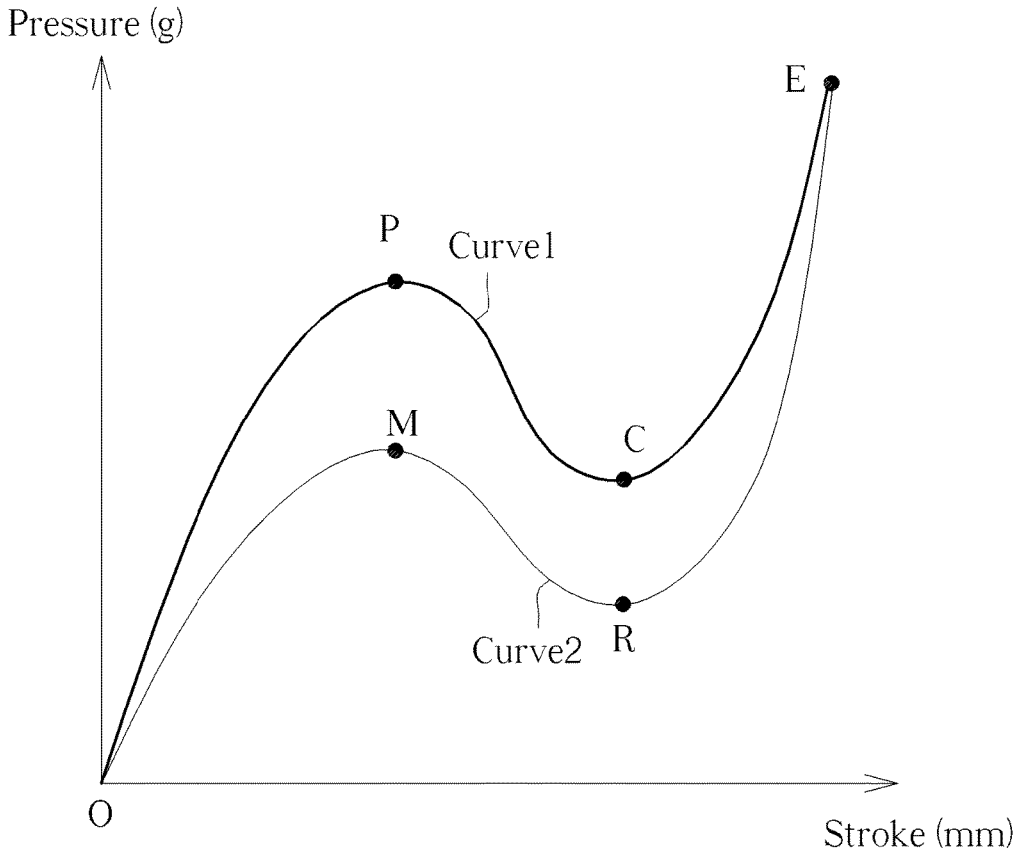
FIG. 1 PRIOR ART
FIG. 1 is a diagram illustrating a bounce curve of a prior art thin film keyboard.
Figure 2:
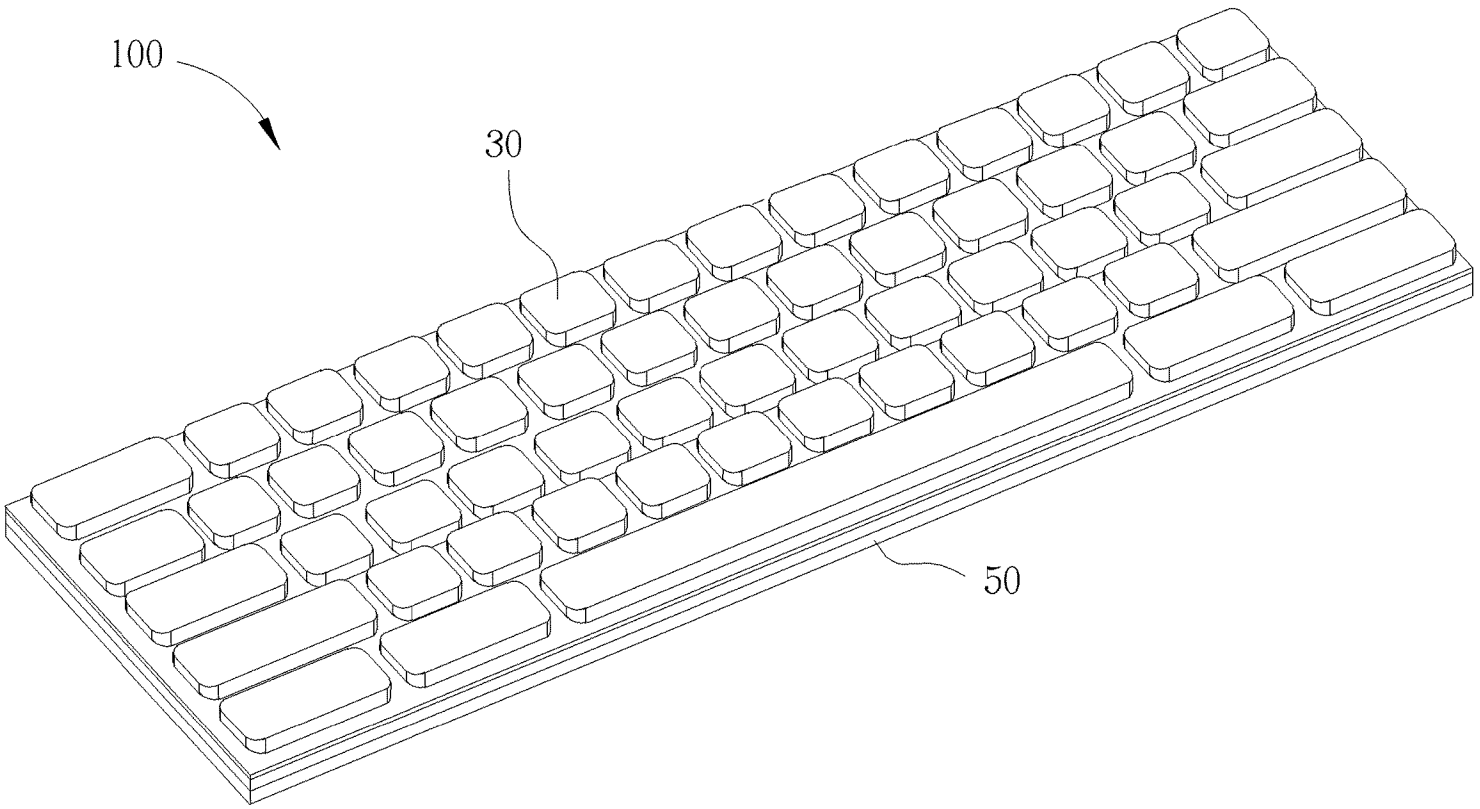
FIG. 2 is a diagram illustrating the exterior view of a keyboard device according to an embodiment of the present invention.

FIG. 2 is a diagram illustrating the exterior view of a keyboard device 100 according to an embodiment of the present invention. The keyboard device 100 includes a substrate 50 and a plurality of convex keycap structures 30 each disposed on the substrate 50 for indicating the corresponding key function or alphanumeric character. In an embodiment, the keyboard device 100 may be used in a keyboard module of a laptop computer, a tablet computer, a TV controller, or a desktop computer. However, the application of the keyboard device 100 does not limit the scope of the present invention.

Figure 3:
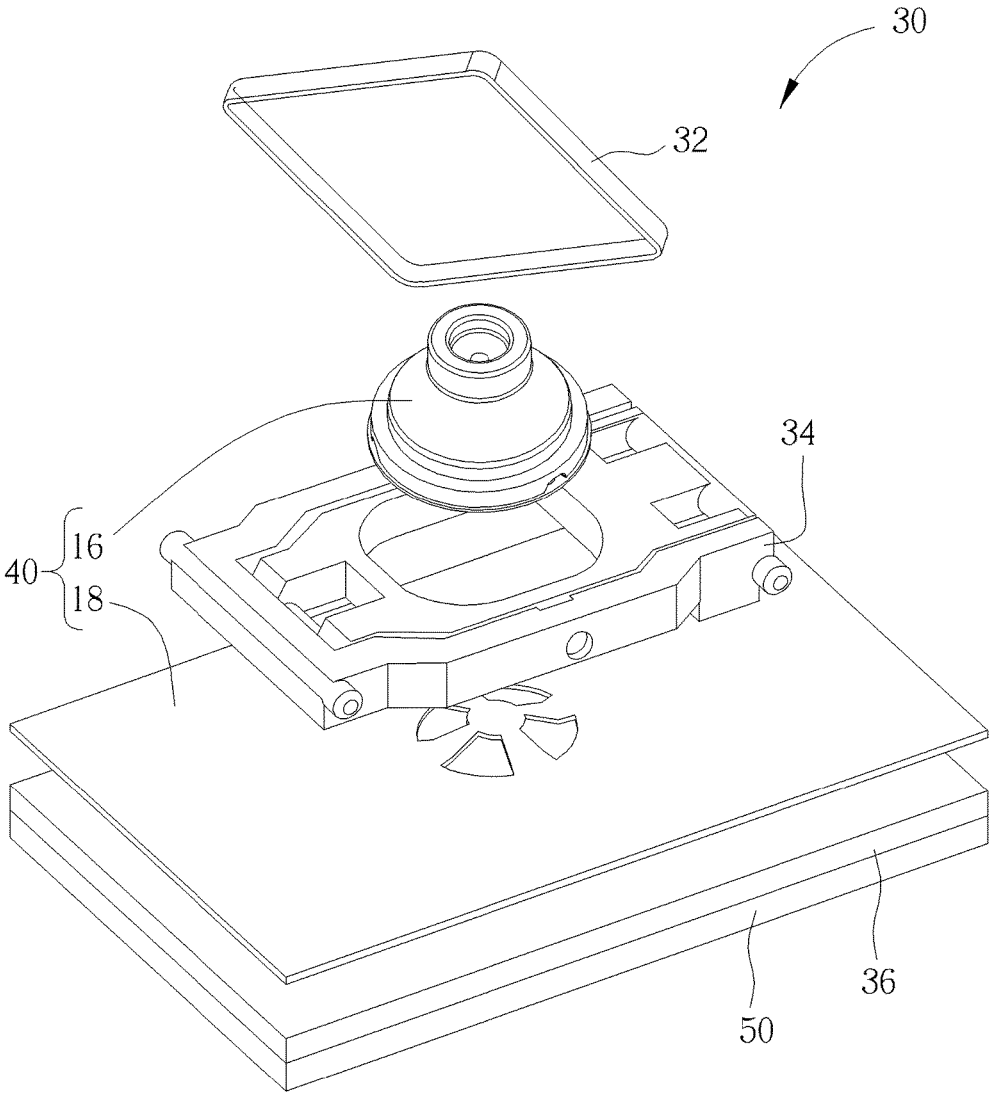
FIG. 3 is a diagram illustrating the explosive view of the keyboard device according to an embodiment of the present invention.
Figure 4:
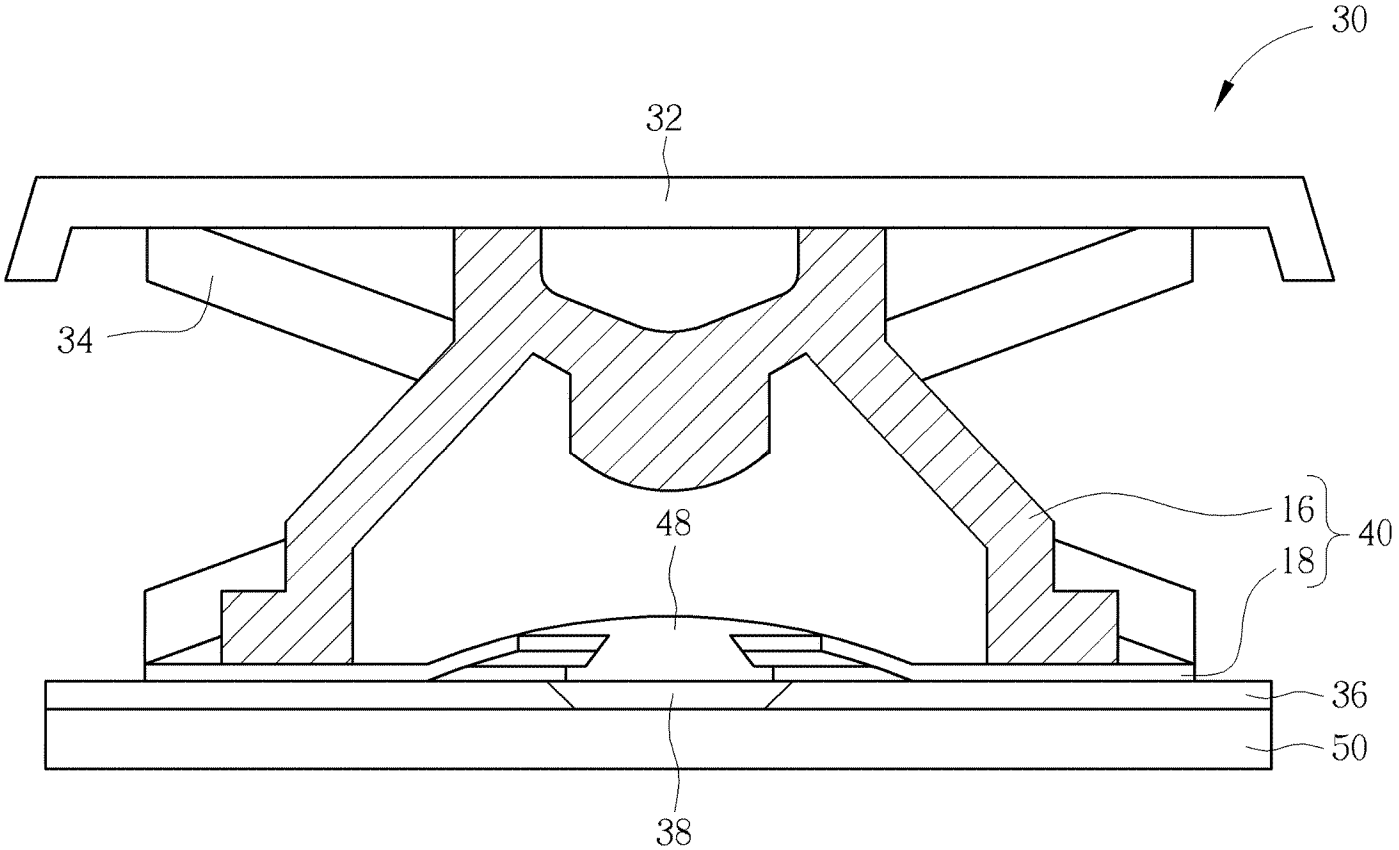
FIG. 4 is a diagram illustrating the cross-sectional view of the keyboard device according to an embodiment of the present invention.
Figure 5:
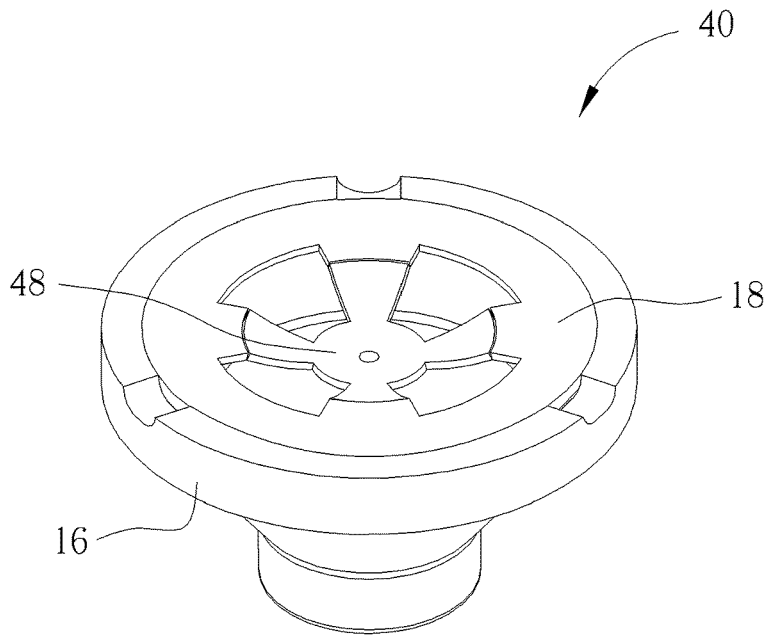
FIG. 5 is a diagram illustrating a trigger device formed by integrating a rubber dome and a metal dome according to an embodiment of the present invention.
Figure 6:
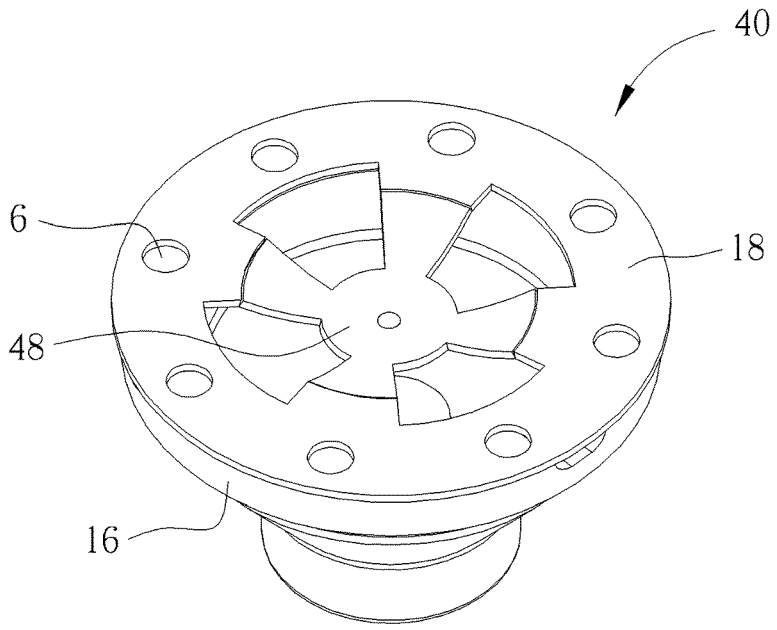
FIG. 6 is a diagram illustrating a trigger device formed by integrating a rubber dome and a metal dome according to another embodiment of the present invention.
Figure 7:
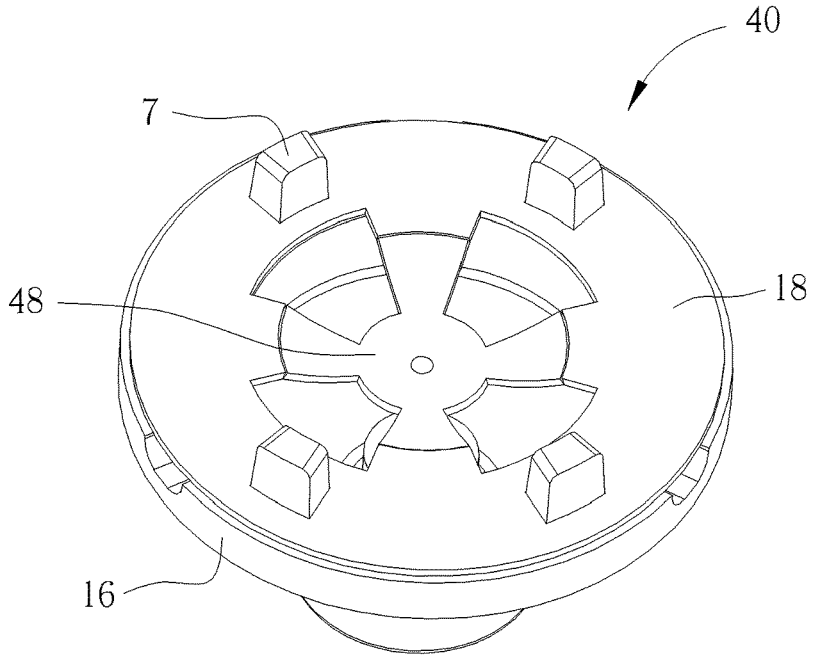
FIG. 7 is a diagram illustrating a trigger device formed by integrating a rubber dome and a metal dome according to another embodiment of the present invention.
Figure 8:
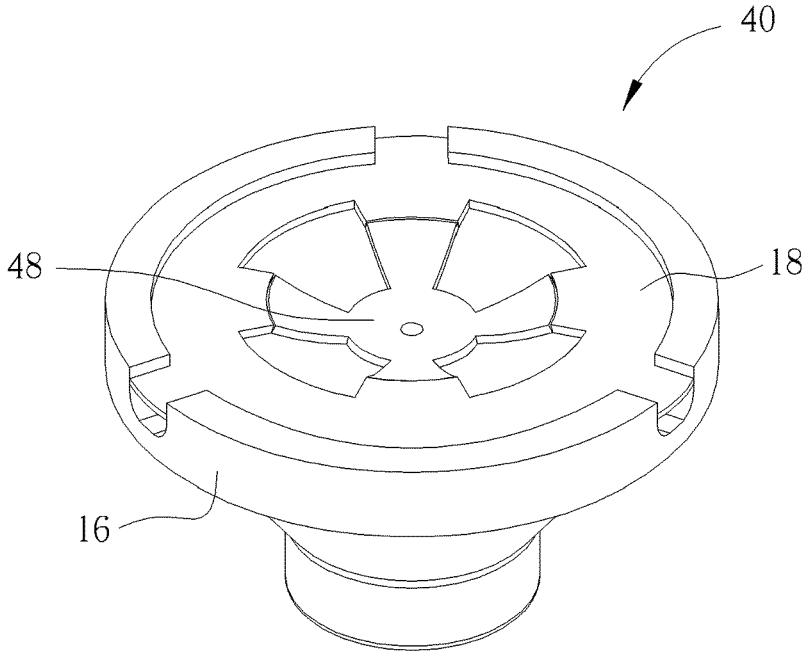
FIG. 8 is a diagram illustrating a trigger device formed by integrating a rubber dome and a metal dome according to another embodiment of the present invention.

FIG. 3 is a diagram illustrating the explosive view of the keyboard device 100 according to an embodiment of the present invention. FIG. 4 is a diagram illustrating the cross-sectional view of the keyboard device 100 according to an embodiment of the present invention. For ease of explanation, FIG. 3 and FIG. 4 only depict the structure of a single convex keycap structure 30, while other convex keycap structures may adopt the same design. Each convex keycap structure 30 in the keyboard device 100 includes a keycap 32, a supporting structure 34, a thin film switch circuit 36, and a trigger device 40 disposed on the substrate 50. The trigger device 40 is an integral of a rubber dome 16 and a metal dome, and its manufacturing method will be described in more details in subsequent paragraphs.

The thin film switch circuit 36 is disposed on the substrate 50 at a location which is under the trigger device 40. The thin film switch circuit 36 includes a plurality of link points 38 each associated with a corresponding keycap 32. When an external force is exerted, the trigger device 40 undergoes deformation and comes in contact with the link points 38, thereby outputting a corresponding keycap signal.

In the present invention, the supporting structure 34 is used to provide smooth stroke of each typing. In the embodiments illustrated in FIG. 3 and FIG. 4, the supporting structure 34 is a scissor-shaped connecting device. In other embodiments, the supporting structure 34 may be a bushing or a spring device. However, the type of the supporting structure 34 does not limit the scope of the present invention.

FIGS. 5~8 are diagrams illustrating the trigger device 40 formed by integrating the rubber dome 16 and the metal dome 18 according to embodiments of the present invention. In the embodiment depicted in FIG. 5, the trigger device 40 is fabricated in a rubber-to-metal molding process in which the material of the rubber dome 16 is directly formed on the surface of the metal dome 18. In the embodiment depicted in FIG. 6, the trigger device 40 is fabricated using a spot welding technique in which local heat is applied to a plurality of contact points 6 after aligning the rubber dome 16 and the metal dome 18. With the contact surfaces of rubber and metal materials melted, the rubber dome 16 and the metal dome 18 may be integrated into each other after cooling down. In the embodiment depicted in FIG. 7, the trigger device 40 is fabricated using a joint structure in which a plurality of tenons 7 are provide at the bottom of the rubber dome 16 and a plurality of mortises are provided at corresponding locations on the metal dome 18 for receiving the plurality of tenons 7 so as to be integrated with the rubber dome 16. In the embodiment depicted in FIG. 8, the trigger device 40 is fabricated using an adhesive technique in which the metal dome 18 is attached to the bottom of the rubber dorm 16 using an adhesive tape.

In the embodiments depicted in FIGS. 5~8, the rubber dome 16 of the trigger device 40 includes a protrusive part 22 at a location corresponding to the link point 38 of the thin film switch circuit 36. The bottom of the metal dome 18 includes a contact surface 48 at a location corresponding to the link point 38 of the thin film switch circuit 36.

Figure 9:
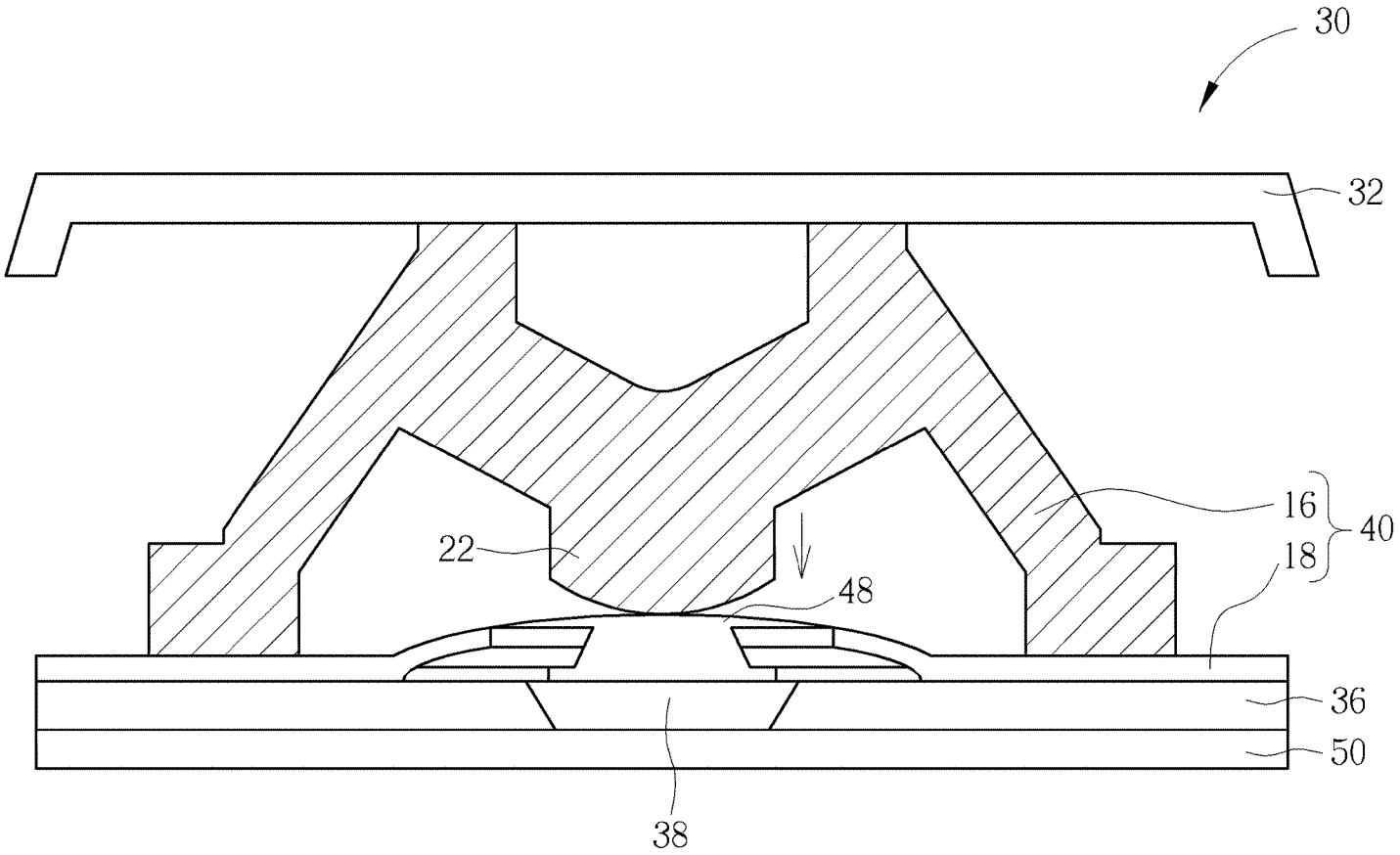
FIG. 9 is a diagram illustrating the operation of a trigger device according to an embodiment of the present invention.
Figure 10:
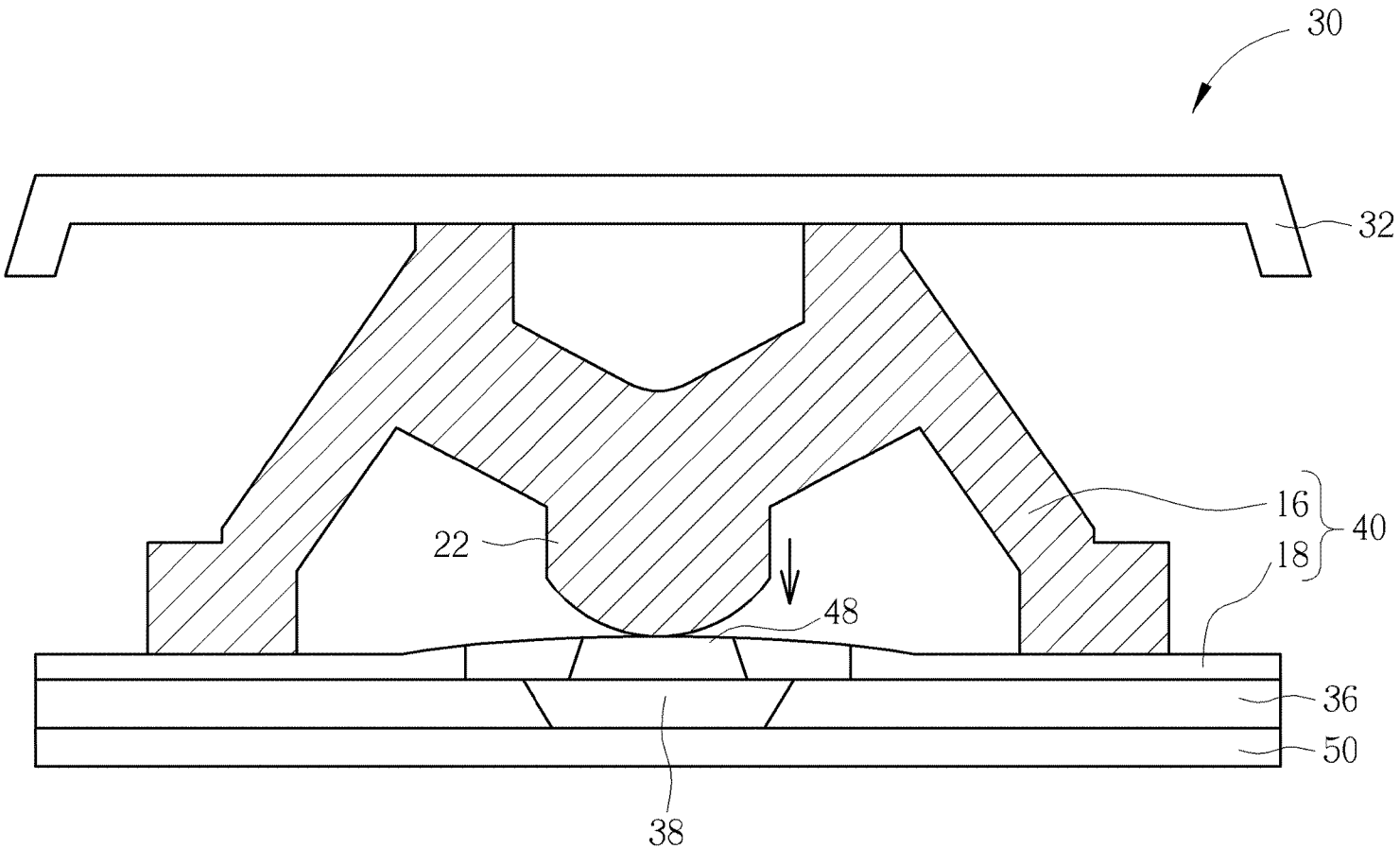
FIG. 10 is a diagram illustrating the operation of a trigger device according to an embodiment of the present invention.

FIG. 9 and FIG. 10 are diagrams illustrating the operation of the trigger device 40 according to embodiments of the present invention. FIG. 9 depicts a first pressing process of the trigger device 40, and FIG. 10 depicts a second pressing process of the trigger device 40. When a user pushes the keycap 32 of a specific convex keycap structure 30, the keycap 32 moves towards the substrate 50, thereby causing the rubber dome 16 to undergo deformation until the protrusive part 20 comes in contact with the metal dome 18, as depicted in FIG. 9. Next, as the user continues to push the keycap 32, the rubber dome 16 eventually flattens the metal dome 18 so that the contact surface 48 on the bottom of the metal dome 18 comes in contact with the link point 38 of the thin film switch circuit 36, as depicted in FIG. 10.

Figure 11:
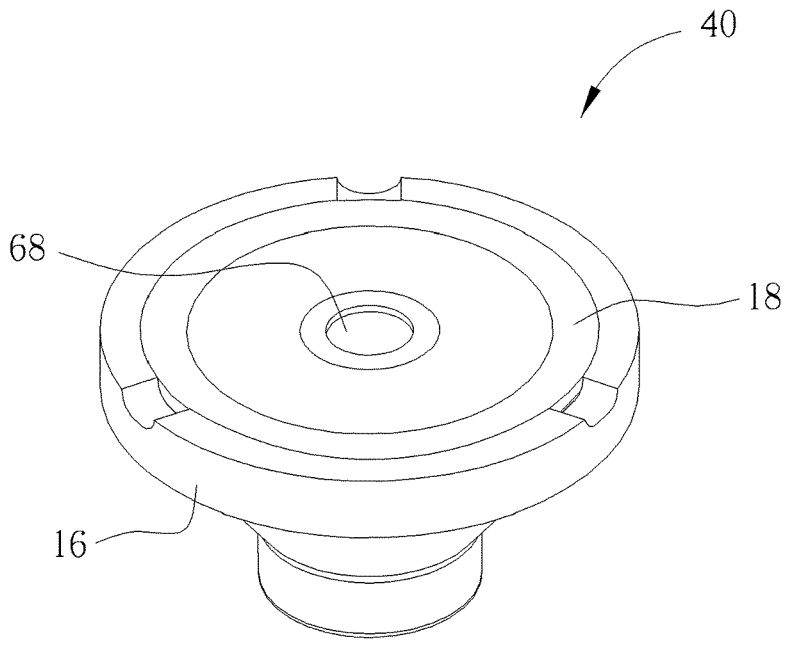
FIG. 11 is a diagram illustrating a trigger device formed by integrating a rubber dome and a metal dome according to another embodiment of the present invention.
Figure 12:
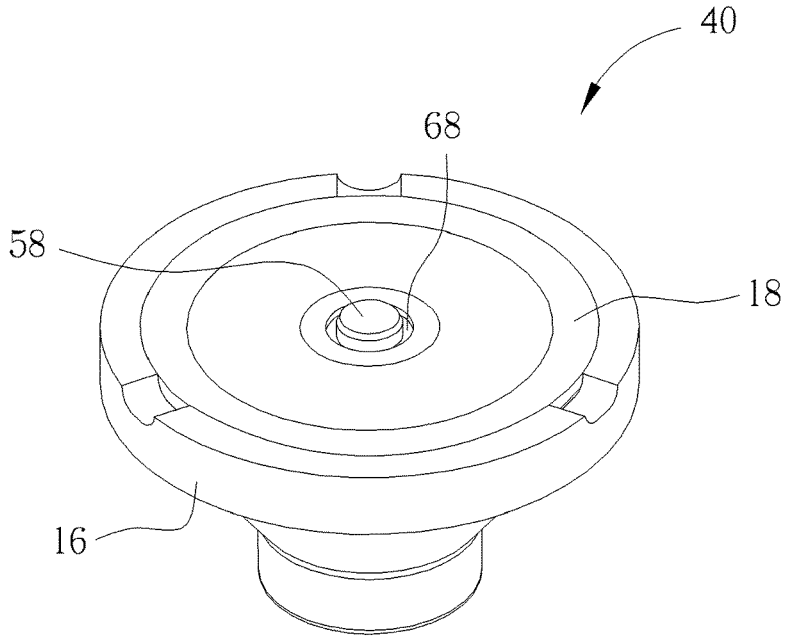
FIG. 12 is a diagram illustrating a trigger device formed by integrating a rubber dome and a metal dome according to another embodiment of the present invention.

FIG. 11 and FIG. 12 are diagrams illustrating the trigger device 40 formed by integrating the rubber dome 16 and the metal dome 18 according to another embodiment of the present invention. FIG. 11 depicts the trigger device 40 when no external force is exerted, and FIG. 12 depicts the trigger device 40 when an external force is exerted. In this embodiment, the bottom of the metal dome 18 includes an opening 68 at a location corresponding to the link point 38 of the thin film switch circuit 36, as depicted in FIG. 11. The protrusive part 22 of the rubber dome 16 includes a contact structure 58 at a location corresponding to the link point 38 of the thin film switch circuit 36. The contact structure 58 may pass through the opening 68 of the metal dome 18, as depicted in FIG. 12.

Figure 13:
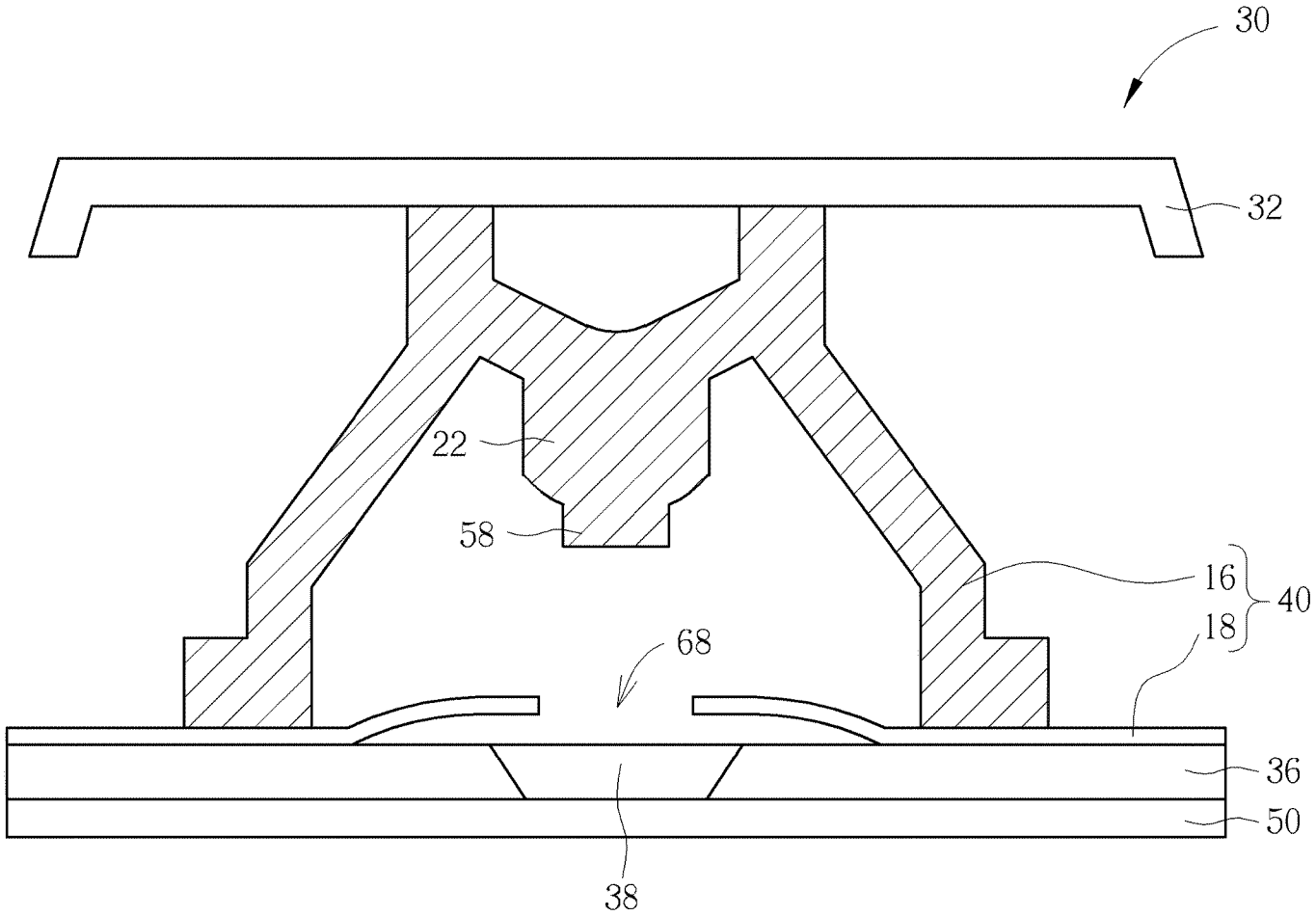
FIG. 13 is a diagram illustrating the operation of a trigger device according to another embodiment of the present invention.
Figure 14:
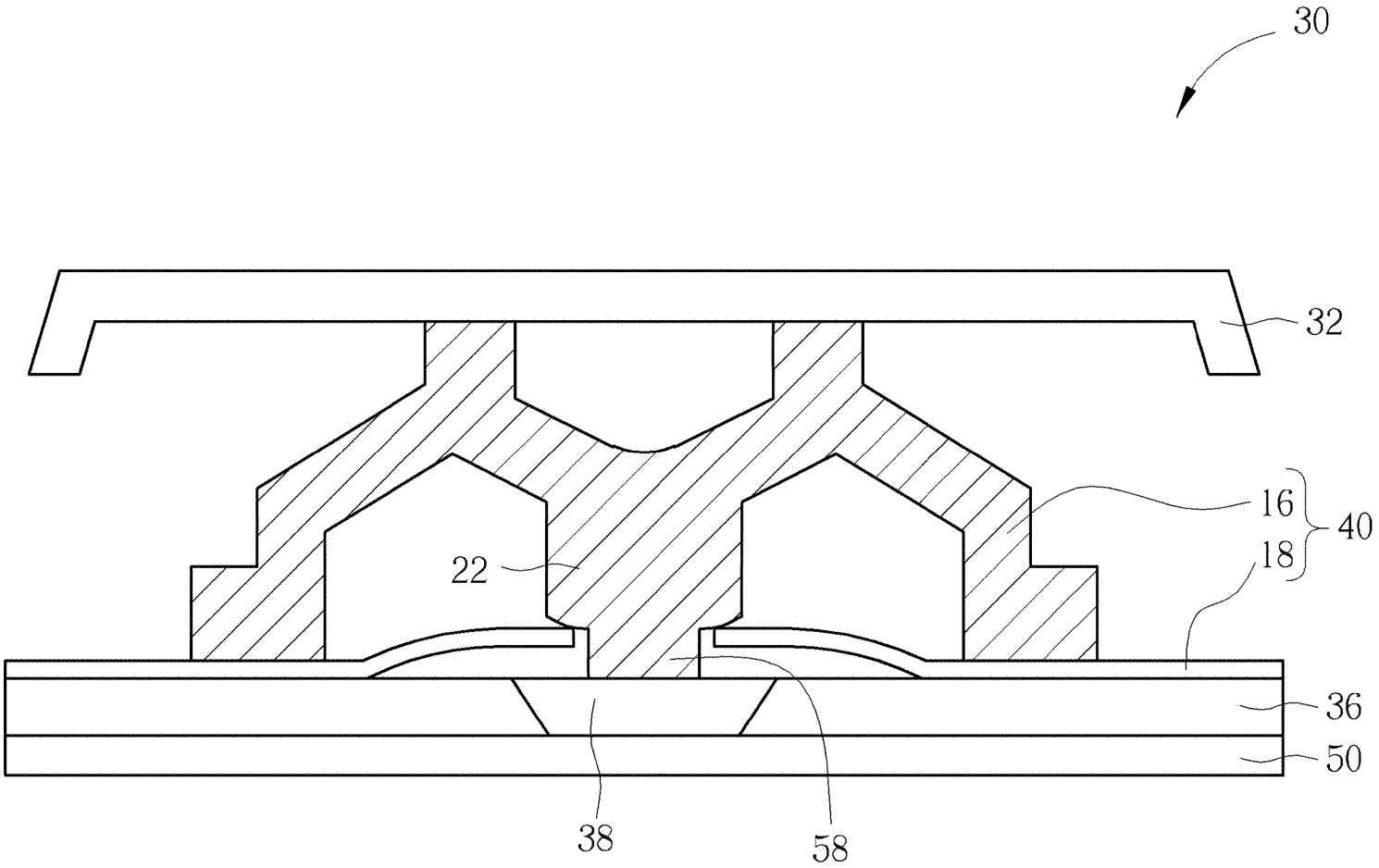
FIG. 14 is a diagram illustrating the operation of a trigger device according to another embodiment of the present invention.
Figure 15:
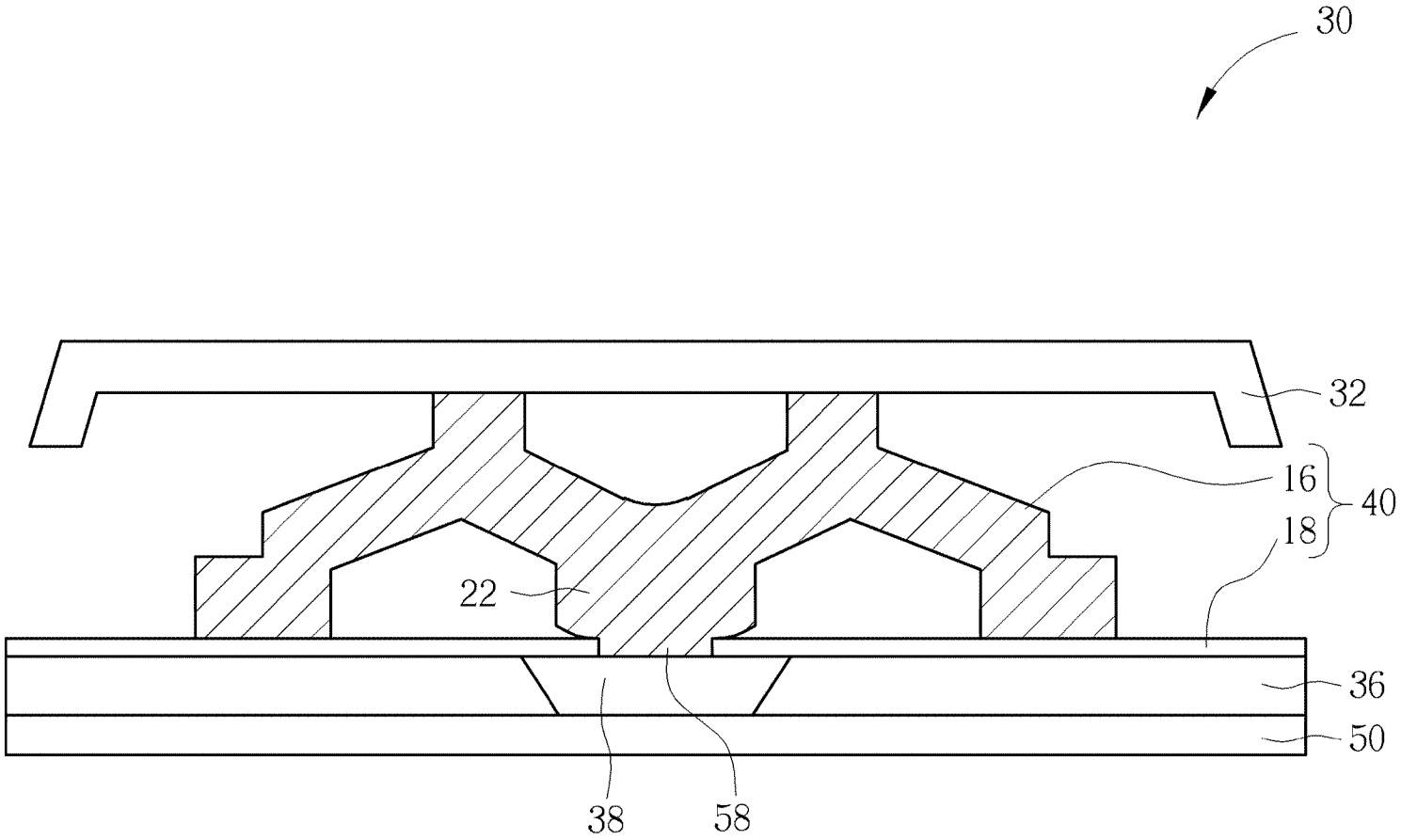
FIG. 15 is a diagram illustrating the operation of a trigger device according to another embodiment of the present invention.

FIGS. 13~15 are diagrams illustrating the operation of the trigger device 40 according to another embodiment of the present invention. FIG. 13 depicts a cross-sectional diagram of the trigger device 40 when no external force is exerted. FIG. 14 depicts a cross-sectional diagram of the trigger device 40 during a first pressing process when an external force is exerted. FIG. 15 depicts a cross-sectional diagram of the trigger device 40 during a second pressing process when an external force is exerted. When a user pushes the keycap 32 of a specific convex keycap structure 30, the keycap 32 moves towards the substrate 50, thereby causing the rubber dome 16 to undergo deformation until the contact structure 58 of the protrusive part 20 passes through the opening 68 of the metal dome 18 and comes in contact with the link point 38 of the thin film switch circuit 36, as depicted in FIG. 14. Next, as the user continues to push the keycap 32, the rubber dome 16 eventually flattens the metal dome 18, as depicted in FIG. 15.

Figure 16:
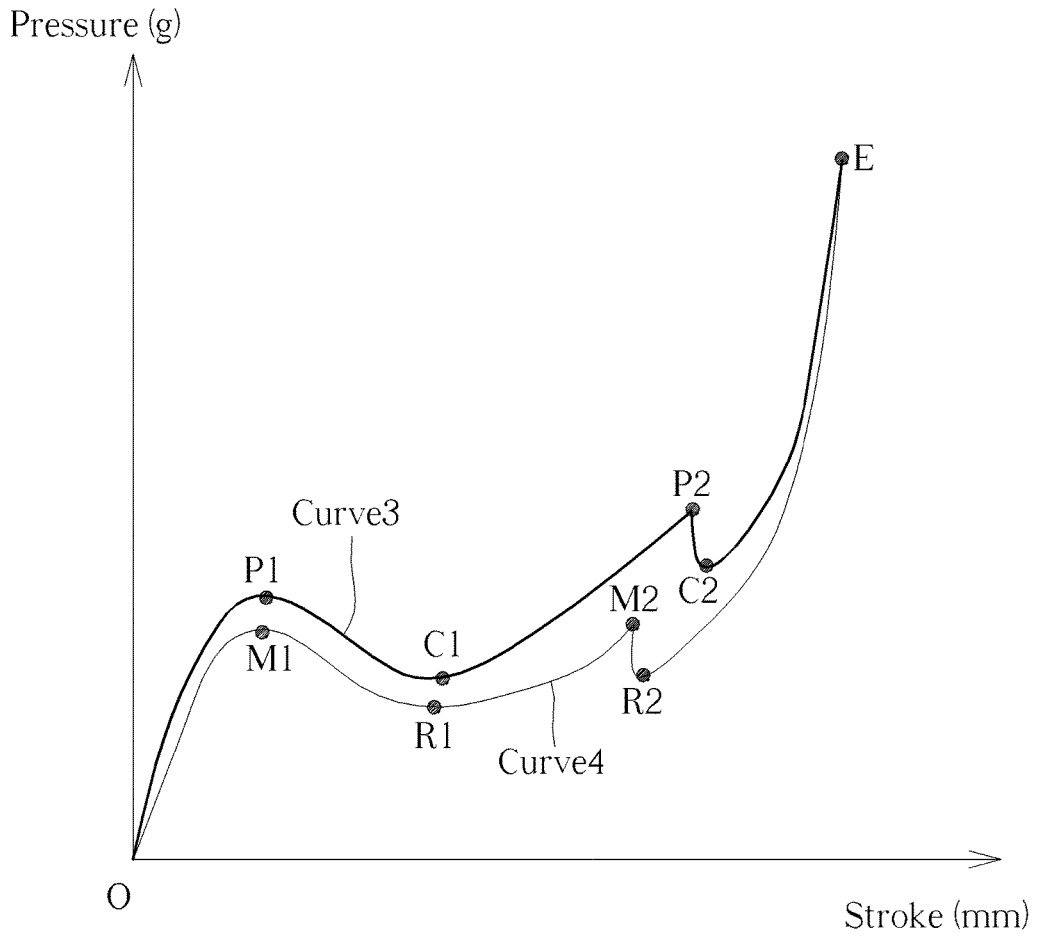
FIG. 16 is a diagram illustrating a bounce curve of a thin film keyboard device according to an embodiment of the present invention.

FIG. 16 is a diagram illustrating a bounce curve of the thin film keyboard device 100 according to an embodiment of the present invention. The horizontal axis represents the distance of keycap stroke (in millimeters). The vertical axis represents the pressure (in grams) observed by user finger when the keycap is being pushed downwards or rebounding. Curve 3 represents the pressing processes when the keycap is being pushed downwards, and Curve 4 represents the relieving processes when the keycap is rebounding. Point O is the start point, Point P1 is the peak point of a first pressing process, Point C1 is the contact point of the first pressing process, Point P2 is the peak point of a second pressing process, Point C2 is the contact point of the second pressing process, Point R1 is the rebound point of the first pressing process, Point M1 is the maximum rebound point of the first pressing process, Point R2 is the rebound point of the second pressing process, Point M2 is the maximum rebound point of the second pressing process, and Point E is the finish point.

As depicted by Curve 3 in FIG. 16, when the user pushes down a keycap, the present invention can provide a first tactile feel between the peak point P1 and the contact point C1 using the deformed rubber dome 16 during the first pressing process, and provide a second tactile feel between the peak point P2 and the contact point C2 using the deformed metal dome 18 during the second pressing process. As depicted by Curve 4 in FIG. 16, after the user releases the keycap, the present invention can provide a second rebound force between the rebound point R2 and the maximum rebound point M2 using the deformed metal dome 18 during the second relieving process, and provide a first rebound force between the rebound point R1 and the maximum rebound point M1 using the deformed rubber dome 16 during the first relieving process.

In conclusion, the present invention can provide a keyboard device with high rebound force similar to that provided by mechanical keyboards, as well as two stages of tactile feel. In gaming applications, the present keyboard device can provide gamers with more accurate maneuverability.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyboard device, comprising:
a substrate;
a thin film switch circuit, disposed on the substrate; and
a trigger device configured to trigger the thin film switch circuit in response to an external force and comprising:
a rubber dome having a protrusive part and arranged to:
provide a first tactile feel during a first pressing process while the external force is exerted; and
provide a first rebound force during a first relieving process after the external force has been removed; and
a metal dome integrated with the rubber dome, and arranged to:
provide a second tactile feel during a second pressing process while the external force is exerted; and
provide a second rebound force during a second relieving process after the external force has been removed, wherein:
the protrusive part includes a contact structure;
the metal dome includes an opening;
the rubber dome undergoes a deformation as a result of the external force exerted during the first pressing process until the contact structure of the protrusive part passes through the opening of the metal dome and comes in contact with the thin film switch; and
the metal dome undergoes a deformation when the protrusive part presses the metal dome during the second pressing process.

2. The keyboard device of claim 1, wherein the rubber dome is directly formed on a surface of the metal dome in a rubber-to-metal molding process.

3. The keyboard device of claim 1, wherein the metal dome is attached to the rubber dome using a spot welding technique.

4. The keyboard device of claim 1, wherein:
the rubber dome includes a plurality of tenons; and
the metal dome includes a plurality of mortises for receiving the plurality of tenons so as to be connected to the rubber dome.

5. The keyboard device of claim 1, wherein
the metal dome is attached to a bottom of the rubber dome using an adhesive tape.

6. The keyboard device of claim 1, further comprising a keycap disposed above the rubber dome for receiving the external force.

7. The keyboard device of claim 1, further comprising a supporting structure disposed between the keycap and the substrate.

8. The keyboard device of claim 7, wherein the supporting structure is a scissor-shaped connecting device, a bushing or a spring device.

9. A keyboard device, comprising:
a substrate;
a thin film switch circuit, disposed on the substrate; and
a trigger device configured to trigger the thin film switch circuit in response to an external force and comprising:
a rubber dome having a protrusive part and a plurality of tenons, and arranged to:
provide a first tactile feel during a first pressing process while the external force is exerted; and
provide a first rebound force during a first relieving process after the external force has been removed; and
a metal dome having a plurality of mortises for receiving the plurality of tenons so as to be integrated with the rubber dome, and arranged to:
provide a second tactile feel during a second pressing process while the external force is exerted; and
provide a second rebound force during a second relieving process after the external force has been removed.

10. The keyboard device of claim 9, wherein:
the rubber dome undergoes a deformation as a result of the external force exerted during the first pressing process until the protrusive part comes in contact with the metal dome; and
the metal dome undergoes a deformation when the protrusive part presses the metal dome during the second pressing process until the metal dome triggers the thin film switch circuit.

* * * * *